United States Patent [19]

Sturlaugson

[11] Patent Number: 4,608,769

[45] Date of Patent: Sep. 2, 1986

[54] SHOE CONSTRUCTION

[76] Inventor: Lee S. Sturlaugson, P.O. Box 178, Park River, N. Dak. 58270

[21] Appl. No.: 655,442

[22] Filed: Sep. 28, 1984

[51] Int. Cl.[4] ..... A43B 21/36

[52] U.S. Cl. ..... 36/68; 36/54; 36/51

[58] Field of Search ..... 36/68, 54, 51, 69, 57, 36/72 R, 136

[56] References Cited

U.S. PATENT DOCUMENTS

| | | | |
|---|---|---|---|
| 1,028,598 | 6/1912 | Papp | 36/54 |
| 1,176,572 | 3/1916 | Lassig | 36/68 |
| 1,229,940 | 6/1917 | Gomes | 36/136 |
| 1,781,950 | 11/1930 | Hilgert | 36/54 |
| 2,245,235 | 6/1941 | Thurston | 36/68 |
| 2,298,941 | 10/1942 | Herrmann | 36/57 |
| 2,568,884 | 9/1951 | Ciaio | 36/68 |
| 2,662,677 | 12/1953 | Perry | 36/136 |
| 2,915,837 | 12/1959 | Schlecht | 36/54 |
| 3,020,169 | 2/1962 | Phillyss, Jr. | 36/68 |
| 3,178,836 | 4/1965 | Turner | 36/72 R |
| 3,616,170 | 10/1971 | Closson | 36/68 |
| 3,803,731 | 4/1974 | Zumbro | 36/57 |
| 3,810,318 | 5/1974 | Epstein | 36/69 |
| 3,952,430 | 4/1976 | Pankin et al. | 36/57 |

*Primary Examiner*—Werner H. Schroeder
*Assistant Examiner*—Mary A. Ellis
*Attorney, Agent, or Firm*—Orrin M. Haugen; Thomas J. Nikolai

[57] ABSTRACT

An improved construction of a shoe which permits the wearer to more readily step into the shoe without the use of his hands and which does not result in damage to the shoe. The shoe's counter incorporates a rigid shoe horn member generally conforming to the shape of the wearer's heel. The lateral edges of the foot receiving opening in the upper of the shoe is rolled and padded so that it does not become crushed as the wearer's foot is slipped into the shoe. The tongue member is reinforced with a stiffner which, too, precludes the tongue from wrinkling and/or rolling up as the foot is inserted into the shoe. Finally, an adjustable elasticized securing mechanism is adapted to bridge the metatarsal arch is included to allow the foot to spread the shoe during entry but which restores the shoe to a tight fit once the foot is inside.

7 Claims, 6 Drawing Figures

SHOE CONSTRUCTION

BACKGROUND OF THE INVENTION

This invention relates generally to foot wear and more specifically to the improved construction of a shoe which increases its comfort and extends its useful life.

A common problem present in most shoe designs, particularly Loafer-type designs, is that they do not permit the wearer to easily slip the shoe on and off while the wearer is standing. Attempts by a wearer, to put a shoe of a conventional design on while standing often cause the back (counter) and sides of the shoe to break down, making the shoe unattractive and uncomfortable. Further, the wearer's repeated attempts to put the shoe on while standing may cause the shoe leather to stretch so that the shoe no longer fits properly and, also, may destroy the finish of the shoe.

Various prior art designs have been developed with a view toward increasing the durability of a conventional shoe design. However, none of the designs have successfully solved the above-described problems. For example, U.S. Pat. No. 738,851 which was issued to J. N. Scisum in 1903 describes a shoe attachment which serves as a shoehorn to assist in putting on the shoe as well as a lining and heel pad. While the invention shown in the Scisum Patent does present certain advantages over a conventional shoe design, it is clearly not as convenient as the design of the present invention since the wearer would still have to bend over and grip the back end of the attachment to use it as a shoe horn. Further, use of the device of the Scisum Patent could cause considerable discomfort.

Another prior art shoe design in which durability of the shoe is addressed is the Lassig U.S. Pat. No. 1,176,572 which issued in March of 1916. The invention described in the Lassig patent, incorporates a pocket formed in the rear of one of the shoes of a pair of shoes for retaining a conventional shoehorn while the shoe is being worn. The shoehorn is not part of the shoe itself, and it is contemplated that there would only be one shoehorn for a pair of shoes rather than a shoehorn built into each of the two shoes of a pair. Again, the inconvenience of having to bend over to put the shoe on and possible discomfort makes the Lassig design quite inferior to that of the present invention.

A significant problem that exists with conventional shoe designs when one attempts to put the shoe on while standing is that the tongue, because it is soft and pliable, may become rolled or buckled thus preventing the foot from being placed within the shoe easily. In the prior art, several patents exist which relate to instep guards for safety shoes. One example is U.S. Pat. No. 2,915,837 which issued to F. H. Schlecht on Dec. 8, 1959. While an instep guard such as the one shown in the Schlecht Patent would prevent the tongue from buckling, twisting or rolling, the entire concept of the guard would prevent it from being used in connection with a shoe which can easily be slipped on and off while standing. Such instep guards are obviously intended to be used with work boots to protect the foot rather than in combination with a conventional shoe design to aid one in putting the shoe on.

Another problem with conventional shoe designs which prevent them from being slipped on and off the foot while the wearer is standing is that the leather soon can become stretched to the point where the shoe no longer fits properly. A unique elastic gore is incorporated into Applicant's design and, in combination with either elastic laces or an elastic tape in conjunction with a buckle, snap, offset closure or Velcro closure, forms a securing mechanism. This securing mechanism allows expansion of the shoe during entry and removal of the foot and causes the shoe to otherwise be in a recoiled configuration. In the prior art, attempts to eliminate the stretching problem usually have taken the form of laces, and an adjustable strap with a buckle, or, more recently, an adjustable strap using a Velcro type fastener (See U.S. Pat. Nos. 4,215,493 and 4,270,285). While these designs do prevent the shoe from becoming stretched they do have the disadvantage of requiring the wearer to bend over to either lace the shoe, buckle the buckle or adjust the Velcro strap to ensure a proper fit. By combining such traditional adjustment mechanisms with the gore and elastic tape or laces, bending to secure the shoe each time it is put on is no longer required. At the same time, the design permits simple periodic adjustments to be made when necessary.

Still another shoe of a conventional design is that the edges of the upper surrounding the foot-receiving opening thereof tend to break down over time, destroying the appearance of the shoe and causing the shoe to become increasingly uncomfortable and unattractive if a wearer repeatedly tries to put the shoe on while standing. Several patents, including U.S. Pat. No. 2,104,598, U.S. Pat. No. 1,920,751 and U.S. Pat. No. 3,803,731, show various ways in which the edges of the upper of a shoe can be re-enforced to prevent them from breaking down. However, none of these patents include, in combination with it a shoehorn type counter, a tongue reinforcement, and a suitable gore or securing mechanism, all of which are necessary in order for the shoe to be easily slipped on and off while the wearer is standing without requiring an inordinate amount of effort or bending by the wearer.

SUMMARY OF THE INVENTION

The present invention involves an improved shoe design which allows the wearer to easily step into the shoe while standing erect. To achieve this result, four unique features are incorporated into the improved design of the invention. First, a somewhat rigid shoehorn shaped counter is integrated with the quarter portion of the shoe to guide the wearer's foot while putting the shoe on and preventing the back of the shoe from being crushed down. The counter is designed in such a way that its shape and size can be varied to conform with the wearer's needs and the style of shoe. Second, to prevent buckling and wrinkling of the tongue portion of the shoe while it is being put on, the tongue is reinforced with a firm material such as plastic, leather or metal. Third, an improved gore or securing mechanism, incorporating an elastic member, is provided to promote adjustability and resiliency and to prevent the leather of the shoe from becoming stretched as the shoe is being placed on the foot. Finally, the lateral upper edges or collar of the shoe are rolled or rolled and padded to provide greater durability, increased comfort and guidance of the wearer's foot into the shoe.

Various advantages and features of novelty which characterize the invention are pointed out with particularity in the claims annexed hereto and forming a part hereof. However, for a better understanding of the invention, its advantages and objects obtained by its use, reference should be had to the drawings which form a further part hereof, and to the accompanying descriptive matter, in which there are illustrated and described certain preferred embodiments of the invention.

DESCRIPTION OF THE DRAWINGS

In the drawings, in which like reference numerals identify like elements throughout the several views.

DESCRIPTION OF THE PREFERRED EMBODIMENT

The present invention is designed to give a wide variety of people footwear which is adjustable, comfortable, attractive and convenient. The invention is particularly useful for people who would be unable to put on conventional footwear because of their age, infirmities or physical problems of the back, hands or any othe portion of their bodies that restrict their ability to put on footwear. The invention also provides significant advantages for extremely obese people, busy people (especially those who must change their footwear several times daily), or anyone else (such as a realtor), who because of their job or for some other reason finds it necessary to take their shoes off and put them back on several times during the course of a day.

Figure 1:
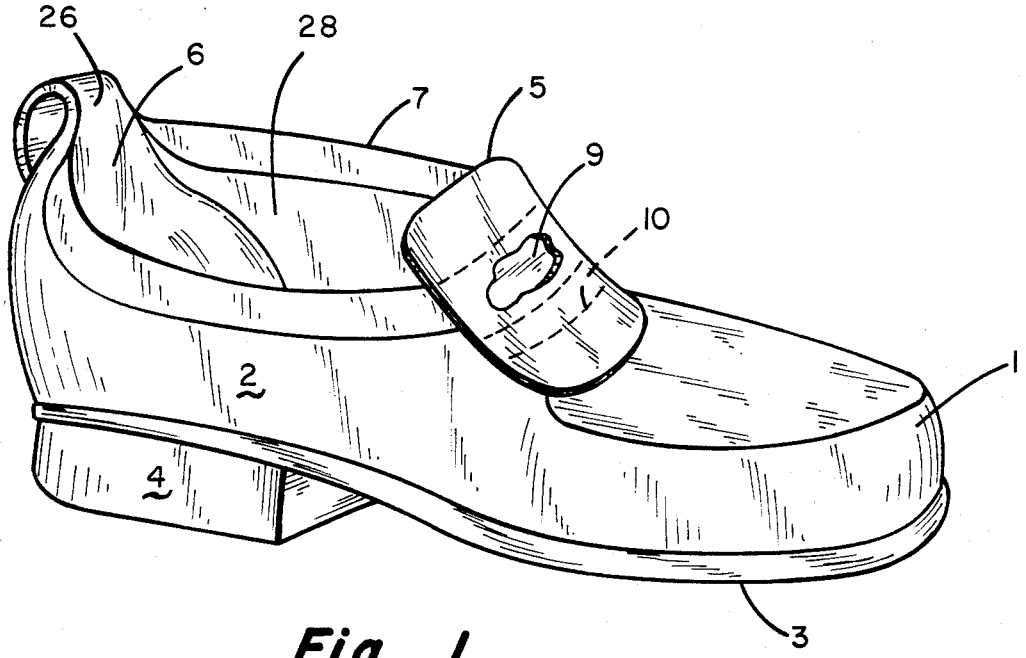
FIG. 1 is a perspective view of one embodiment of the invention.

Referring first to FIG. 1 of the drawings, a shoe according to the invention is shown to comprise an upper including a toe portion 1, a side wall 2, a sole 3, a heel 4, and a tongue 5. Also included in the design, and which make the invention unique from conventional shoe designs, are a shoehorn shaped counter member 6 which is incorporated in between the interior lining and the outer or exterior layer of leather, rolled or padded lateral upper edges 7 and 8, a firm reinforced tongue support 9, and an adjustable elasticized securing mechanism 10.

Figure 2:
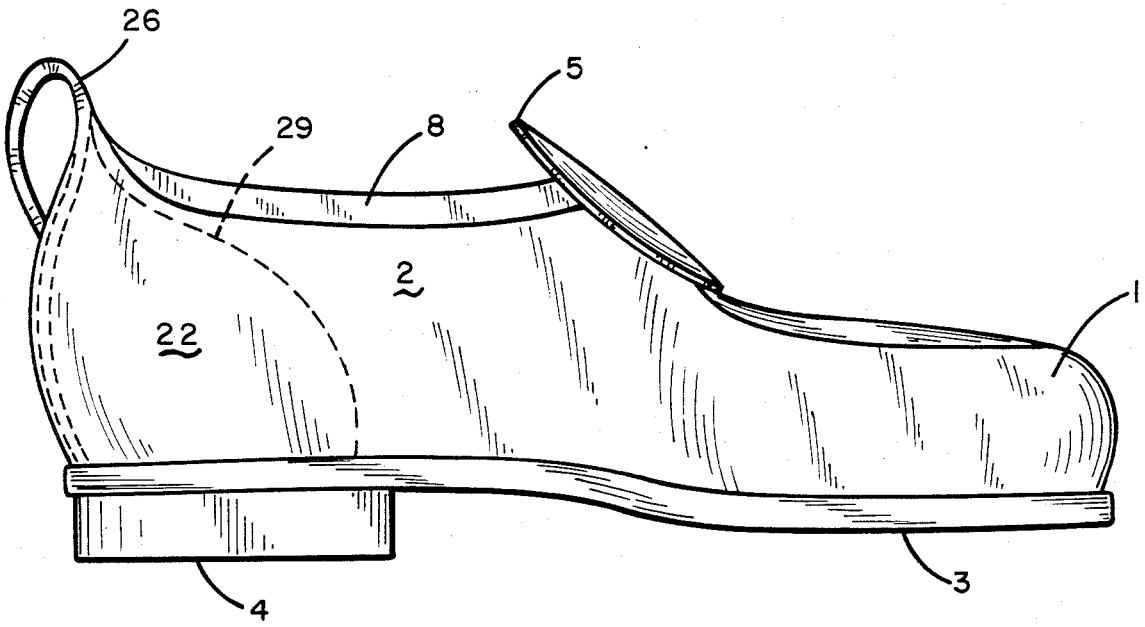
FIG. 2 is a cross-sectional side view of the embodiment of FIG. 1.
Figure 3:
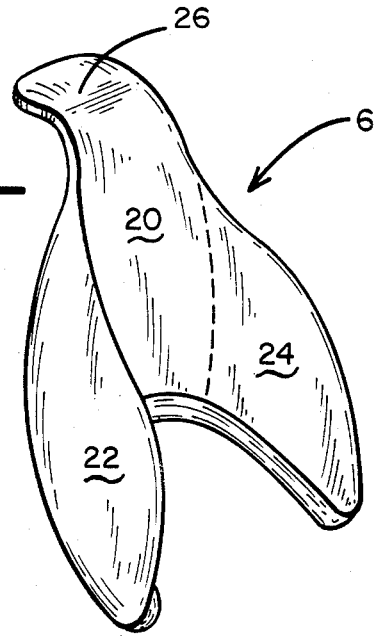
FIG. 3 is a perspective view of the shoehorn counter of the invention.
Figure 4:
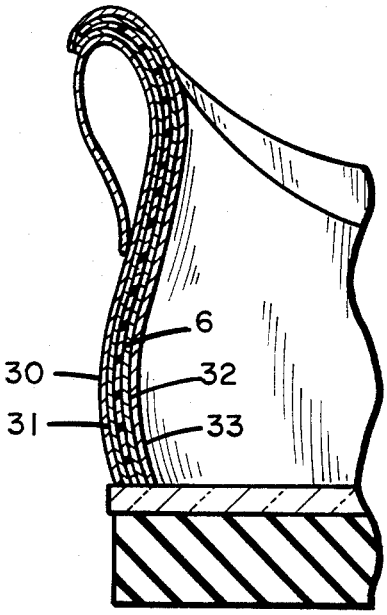
FIG. 4 is a partial view of the preferred embodiment showing the shoehorn counter in its assembled location between the inner leather and the inside lining of the shoe with the remaining parts of the shoe.

Shown more clearly in FIGS. 2 through 4 is a preferred form of the shoehorn shaped counter 6. It is constructed of a rigid material such as plastic, metal, stiffened leather or reinforced cardboard. Counter 6 is constructed so that it has a rear portion 20 which conforms to the shape of the back of the shoe and two side portions 22 and 24 for reinforcing the shoe at the lateral heel portions of the quarter. Further, the counter has an upper portion 26 which angularly projects upward and outward from the shoe cavity 28 and which has a shape similar to that of a conventional heel-engaging shoehorn. FIG. 2 demonstrates by the hidden lines 29 the location of the side portions 22 and 24 of the counter 6 and shows how they help support the side wall 2 of the shoe quarter. The partial view of FIG. 4 shows that the shoe, in the area of counter 6, has 5 layers: an outside leather layer 30; an outside pad of compressible material 31; shoehorn shaped counter 6; an inside pad of compressible material 32; and an inside lining 33. Those skilled in the art will recognize that outside leather layer 30, pads 31 and 32 as well as the inside lining 33 will be retained with respect to each other by stitching them together. Since the counter 6 is sandwiched between pads 31 and 32, the counter will also be retained in place by such stitching.

Those skilled in the art will also recognize that side portions 22 and 24 can be extended forward to any point along the entire length of the sidewalls 2 to insure a fit providing optimum comfort. Likewise, the upper posterior portion 26 of counter 6 can be extended upward in various lengths to accommodate footwear higher than oxford-type footwear such as boots or the like.

Referring back to FIGS. 1 and 2, rolled or rolled and padded edges 7 and 8 about the foot receiving opening are present to promote a snug fit while, at the same time, insuring that the top portion of the side wall of the shoe does not become stepped down and damaged while the shoe is being placed on the foot. These rolled edges can be constructed by rolling the leather over and stitching along the lower edge of the rolled portion. If desired, padding can be added to the pocket formed by rolling the edges over prior to stitching for greater comfort and durability.

Figure 5:
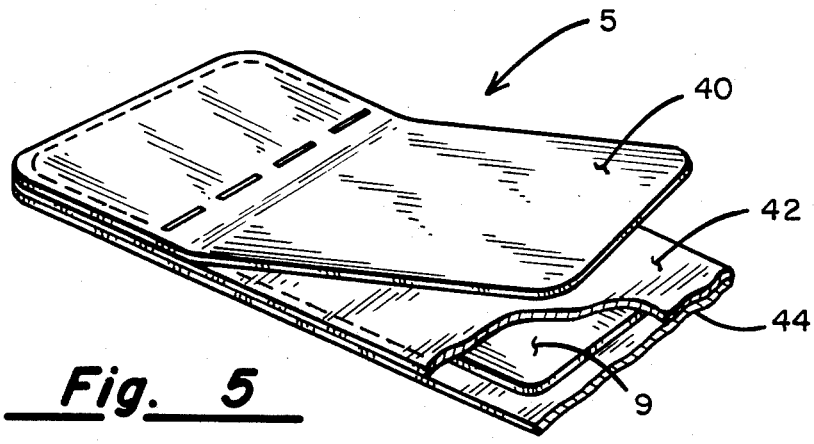
FIG. 5 is a perspective view of the tongue and its reinforcement as assembled in the preferred embodiment with a decorative flap attached.

Turning now to FIG. 5, the preferred construction of the tongue member is identified by numeral 5. Located between the inside lining 44 and the outside leather portion 42 is a piece of reinforcing material 9 which is constructed of either plastic, metal, leather, cardboard or some other suitable material by reinforcing the tongue 5 with the member 9, the tongue does not fold or wrinkle when the wearer steps into the shoe without pulling the shoe on by hand. The reinforcing material 9 is located under the securing mechanism 10 to permit smooth entry of the toes and metatarsal area of the foot. A flap such as 40 may be added by sewing it to the outside upper portion of the tongue 5 to allow covering of the elastized securing mechanism 10 if desired for styling, as commonly seen in golf shoes.

Figure 6:
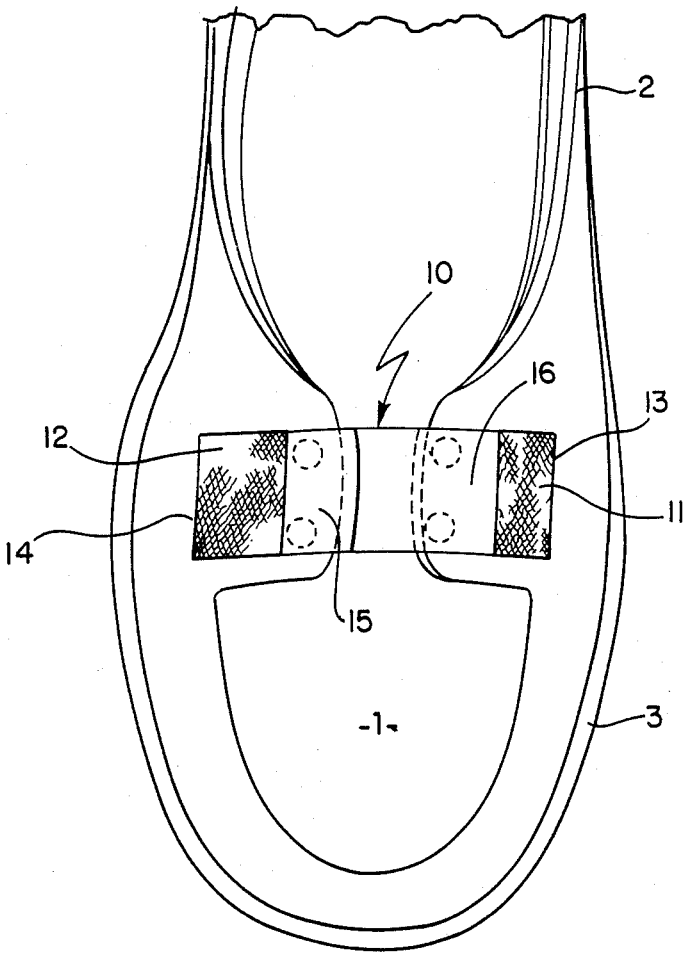
FIG. 6 is a plan view of the front portion of the shoe with the tongue repositioned to better illustrate the elasticized adjustment feature.

Referring to FIG. 6, there is a shown a plan view of the embodiment of FIG. 1 but with the reinforced tongue removed to reveal the adjustable elasticized securing mechanism indicated generally by numeral 10. It is seen to comprise first and second elastic straps 11 and 12 which are secured at their outermost edges 13 and 14 to the shoe top 1 by stitching or other suitable fastening means. The three ends of the elasticized strips 11 and 12 are, in turn, sewn or otherwise attached to non-extensible straps 15 and 16 which are arranged to overlap one another as illustrated. Disposed between the overlapped eyes and extensible straps is a suitable fastening device, such as the Velcro hook and loop material. As already pointed out in the introductory portion of this application, a buckle, snap or other securing mechanism may be used as well. Furthermore, it is not essential to the proper working of the adjustable elastic securing mechanism 10 that it be provided with elastic material, such as 11 and 12, on each end of the strap segments 15 and 16. It is sufficient if only one of the aforementioned straps 15 or 16 is secured to the shoe upper, via an elastic segment 11 or 12.

The design of the invention is particularly advantageous during a shoe's normal break-in period because, to a certain extent, the shoe is self-adjusting, thus preventing discomfort and injury to the foot. Another unique advantage is that the design permits the use of different weight stockings. Still another advantage of the present design is that it allows the shoe to conform to feet of slightly differing shapes or sizes and can be adjusted individually for a comfortable fit.

While the above description and the drawings all relate to one embodiment showing the invention, it is apparent that one skilled in the art, given the above disclosure, could incorporate the invention into a variety of shoe or boot designs to achieve the same significant advantages. Further, given the above disclosure, it would be apparent to one skilled in the art that the various parts of the shoe could be constructed out of a variety of material without deviating from the invention. For example, man-made materials could be used rather than leather for the various shoe parts. In addition, the various counters and supports of the design can be constructed out of a wide variety of materials such as metal, leather, plastic or nylon.

The shoe design of the present invention is thus seen to include three important features working in combination to yield a shoe which can readily be stepped into and worn without requiring the wearer to use his or her hands. The features include a shoe horn-shaped rigid member which is shaped to conform to the back of the shoe while the two side portions 22 and 24 thereof reinforce the lateral heel portions of the shoe quarter. This feature helps guide the foot upon insertion and prevents the counter from being inadvertently crushed as the wearer steps into the shoe. The second feature of the combination is the reinforced tongue which keeps it from buckling as the foot is inserted into the shoe. The third feature is the elasticized adjustable securing mechanism that attaches to the sides of the upper vamp flap to the ends of the securing mechanism. Using this arrangement, it is possible to adapt the shoe to provide enough "give" as the metatarsal arch is fitted into the shoe.

Numerous characteristics and advantages of the invention have been set forth in the foregoing description, together with details of structure and function of the invention, and novel features thereof are pointed out in the appended claims. The disclosure, however, is illustrative only, and changes may be made in detail, especially in matters of shape, size and arrangements of parts, or style of the shoe, within the principles of the invention, to the full extent indicated by the broad, general meaning of the terms in which the appended claims are expressed.

I claim:

1. An improved shoe construction comprising:

(a) a sole portion;

(b) an upper having an internal lining, a heel end, a toe end and a foot-receiving opening defined by a side wall secured to said sole portion and projecting upwardly from said sole portion, said side wall having a pair of transversely extending flaps adapted to conform to the wearer's metatarsal arch;

(c) a length adjustable, elasticized securing mechanism fastened to and extending between said transversely extending flaps;

(d) rear counter means located at the heel end of said upper, said rear counter means including a generally rigid, non-bending, laterally arcuate, heel conforming insert member disposed between said lining and said upper; and (e) tongue means located beneath the length adjustable, elasticized securing mechanism and attached to said upper of a size sufficient to span the opening between said pair of transversely extending flaps and having an exterior layer of material, an interior layer of material and a reinforcing stiffening member disposed between said exterior and interior layers to inhibit wrinkling and folding of said tongue means as the wearer's foot is being inserted through said foot-receiving opening and into said shoe.

2. The shoe of claim 1 wherein the rear counter means has the shape of a conventional shoehorn.

3. The shoe of claim 1 wherein the reinforcing stiffening member of said tongue includes a plate of stiff material selected from the class including leather, plastic and metal.

4. The shoe of claim 1 wherein said length adjustable elasticized securing mechanism includes an elastic strap formed from two distinct lengths each length having an outer and an inner end each of the two outer ends being connected to one of said pair of transversely extending flaps and the two inner ends connected to one another via an adjustable separable fastener means.

5. The shoe of claim 1 wherein the tongue means includes exterior layer of material of said tongue means thereby covering said length adjustable elasticized securing mechanism.

6. The shoe of claim 1 wherein said rigid, non-bending material is a metal.

7. The shoe of claim 1 wherein said rigid, non-bending material is a plastic.

* * * * *